US006820963B2

(12) United States Patent
Stauffer et al.

(10) Patent No.: US 6,820,963 B2
(45) Date of Patent: Nov. 23, 2004

(54) FLUID EJECTION HEAD

(75) Inventors: Jill Stauffer, Monmouth, OR (US); Clayton L. Holstun, San Marcos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 43 days.

(21) Appl. No.: 10/353,487

(22) Filed: Jan. 28, 2003

(65) Prior Publication Data

US 2004/0145626 A1 Jul. 29, 2004

Related U.S. Application Data

(63) Continuation-in-part of application No. 10/016,886, filed on Dec. 13, 2001, now abandoned.

(51) Int. Cl.[7] ..... B41J 2/21
(52) U.S. Cl. ..... 347/43; 347/47
(58) Field of Search ..... 347/43, 40, 47, 347/85–87; 216/27

(56) References Cited

U.S. PATENT DOCUMENTS 4,599,627 A 7/1986 Vollert
5,774,145 A * 6/1998 Morita et al. ..... 347/43
5,847,725 A 12/1998 Cleland et al.
6,132,028 A 10/2000 Su et al.
6,302,515 B2 10/2001 Wolf et al.
6,325,485 B2 12/2001 Xu et al.
6,406,122 B1 6/2002 Sharma et al.

FOREIGN PATENT DOCUMENTS

EP 0 943 441 9/1999
JP 07-017062 * 1/1995

* cited by examiner

*Primary Examiner*—Shih-Wen Hsieh

(57) ABSTRACT

A fluid ejection head is disclosed, wherein the fluid ejection head includes an orifice layer disposed on top of a substrate layer. The fluid ejection head includes a first group of fluid ejection orifices and a second group of fluid ejection orifices formed in the fluid ejection head, wherein the first group of fluid ejection orifices and the second group of fluid ejection orifices are configured to eject two different fluids, and an elongate channel formed in the fluid ejection head, wherein the channel is positioned between the first group of fluid ejection orifices and the second group of fluid ejection orifices in such a location as to inhibit cross-contamination of fluids ejected from the first group of fluid ejection orifices and second group of fluid ejection orifices.

41 Claims, 3 Drawing Sheets

FLUID EJECTION HEAD

CROSS REFERENCE TO RELATED APPLICATIONS

This application is a continuation-in-part of U.S. patent application Ser. No. 10/016,886 of Todd A. Cleland et al. for A METHOD OF MANUFACTURING AN ORIFICE PLATE HAVING A PLURALITY OF SLITS, filed Dec. 13, 2001, now abandoned the disclosure of which is hereby incorporated by reference.

BACKGROUND

Fluid ejection devices may find uses in a variety of different technologies. For example, some printing devices, such as printers, copiers and fax machines, print by ejecting tiny droplets of a printing fluid from an array of fluid ejection orifices onto the printing medium. The fluid ejection mechanisms are typically formed on a fluid ejection head that is movably coupled to the body of the printing device. Careful control of such factors as the individual fluid ejection mechanisms, the movement of the fluid ejection head across the printing medium, and the movement of the medium through the device allows a desired image to be formed on the medium.

Some fluid ejection devices may be configured to eject a plurality of different fluids, such as different ink colors and/or compositions, from a single fluid ejection head. In such a fluid ejection head, each individual fluid is typically ejected from a group of closely spaced fluid ejection orifices, and the different groups of orifices for the different fluids are spaced a greater distance apart. The use of such a fluid ejection head may offer several advantages over the use of separate fluid ejection heads for each different fluid. For example, a single, fluid ejection head is typically less expensive than multiple fluid ejection heads, and also may use less space than multiple fluid ejection heads for a fluid ejection device of a comparable size.

While the use of a single fluid ejection head to eject a plurality of different fluids may offer advantages over the use of multiple fluid ejection heads, such a fluid ejection head may also present various problems. For example, when printing with (or otherwise using) any fluid ejection device, small droplets of fluids may end up on the surface of the fluid ejection head surrounding the orifice from which it was ejected, instead of onto the intended medium. Where the fluid ejection head is configured to eject multiple fluids, these stray droplets may contaminate an adjacent fluid ejection orifice for a different fluid, and thus cause undesirable mixing of fluids.

Also, many fluid ejection devices include a wiper structure to clean the fluid ejection head of stray fluid droplets. Typically, the wiper structure wipes across the fluid ejection head surface, pushing a wave of fluid or fluids in front of it. Depending upon the separation of the different fluid ejection orifices, the size of the fluid ejection head, and the configuration and direction of movement of the wiper structure, the wiper structure may mix the different fluids, and thus may cause the contamination of fluid ejection orifices of one type of fluid with other fluids.

The mixing of fluids may cause problems with color reproduction, and may cause other problems as well. For example, some fluids commonly used with fluid ejection devices are configured to react with other fluids ejected from the same device. Inks with this property are referred to generally as "reactive inks." If one of the reacting fluids is not an ink, it may be referred to as a "fixer fluid." Where two reactive fluids are ejected from the same fluid ejection device, the fluids may be configured to immediately harden at the boundary where the drop of one fluid meets a drop of the other fluid to prevent color mixing and/or bleeding on a fluid-receiving medium. Thus, where one reactive fluid contaminates the ejection orifices of a different reactive fluid, the fluids may harden and clog the ejection orifice. The hardened fluids may then be difficult to remove by "spitting", or firing fluids through the orifice at a cleaning station.

These problems may be somewhat reduced by increasing the size of the fluid ejection head, and spreading the fluid ejection orifices for each fluid farther away from orifices of other fluids. However, this may increase the cost and size of the fluid ejection device, and thus may negate some of the advantages of the use of a single fluid ejection head to eject multiple fluids.

SUMMARY

Some embodiments of the present invention provide a fluid ejection head, wherein the fluid ejection head includes an orifice layer disposed on top of a substrate layer. The fluid ejection head also includes a first group of fluid ejection orifices and a second group of fluid ejection orifices formed in the fluid ejection head, wherein the first group of fluid ejection orifices and the second group of fluid ejection orifices are configured to eject two different fluids, and an elongate channel formed in the fluid ejection head, wherein the channel is positioned between the first group of fluid ejection orifices and the second group of fluid ejection orifices in such a location as to inhibit cross-contamination of fluids ejected from the first group of fluid ejection orifices and second group of fluid ejection orifices.

DETAILED DESCRIPTION

Figure 1:
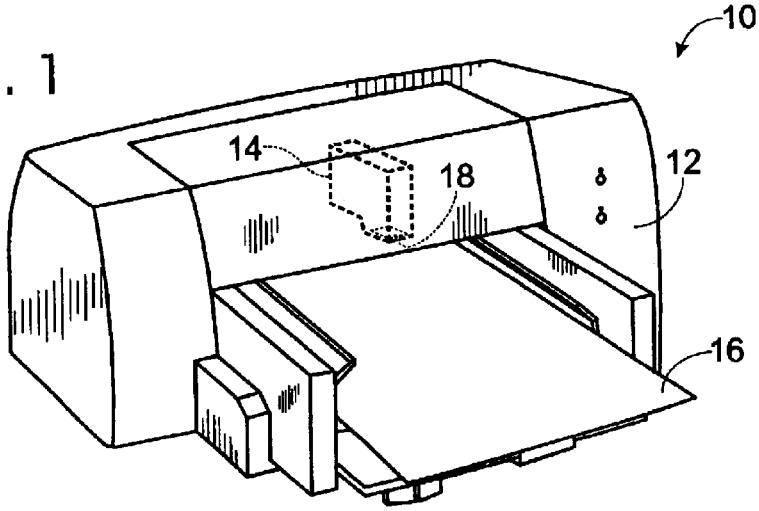
FIG. 1 is an isometric view of a fluid ejection device according to one embodiment of the present invention.

FIG. 1 shows, generally at 10, one exemplary embodiment of a fluid ejection device according to the present invention. Fluid ejection device 10 takes the form of a desktop printer, and includes a body 12, and a fluid ejection cartridge 14 operatively coupled to the body. Fluid ejection cartridge 14 is configured to deposit a fluid onto a medium 16 positioned adjacent to the cartridge via a fluid ejection head 18. Control circuitry in fluid ejection device 10 controls the movement of fluid ejection cartridge 14 across medium 16, the movement of the medium under the fluid ejection cartridge, and the firing of fluid from the individual fluid ejection orifices on the fluid ejection cartridge.

Although shown herein in the context of a printing device, a fluid ejection device according to the present invention may be used in any number of different applications. Furthermore, while the depicted printing device takes the form of a desktop printer, a fluid ejection device according to the present invention may take the form of any other suitable type of printing device, such as a copier or a facsimile machine, and may have any other desired size, large- or small-format.

Figure 2:
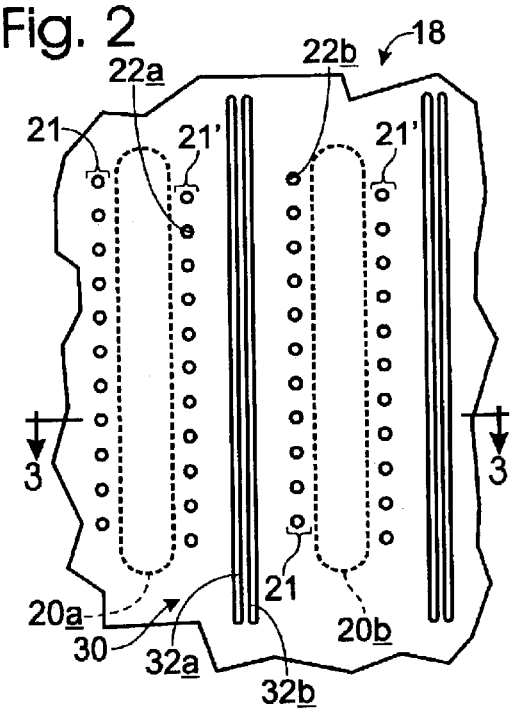
FIG. 2 is a magnified, broken-away plan view of a first alternative fluid ejection head of the embodiment of FIG. 1.

FIG. 2 shows a magnified plan view of a portion of the surface of fluid ejection head 18. Fluid ejection head 18 includes a first fluid feed slot 20*a* for delivering a first fluid to the fluid ejection headband a second fluid feed slot 20*b* for delivering a second fluid to the fluid ejection head. Only two fluid feed slots are shown for clarity. However, it will be appreciated that a fluid ejection head according to the present invention may have any desired number of fluid feed slots, and generally at least one for each type of fluid ejected. For example, a six-color fluid ejection head may have six or more fluid feed slots.

Fluid ejection head 18 also includes at least one fluid ejection orifice for each fluid feed slot 20*a,b*. In the depicted embodiment, fluid ejection head 18 includes two separate columns of orifices, indicated at 21 and 21', for each fluid feed slot. The orifices corresponding to fluid feed slot 20*a* are shown at 22*a*, and the orifices corresponding to fluid feed slot 20*b* are shown at 22*b*. The use of columns of orifices 22*a* and 22*b* to eject fluids helps to decrease the width of the fluid ejection head or carriage as fluid ejection head 18 is passed across medium 16, and thus helps to decrease the time to print a desired image. While each fluid feed slot 20*a* and 20*b* of the depicted embodiment has two associated columns of fluid ejection orifices, it will be appreciated that each fluid feed slot may also have only a single column of associated fluid ejection orifices, or more than two columns of orifices.

With recent advances in fluid ejection technology, it has become possible to place fluid feed slots 20*a* and 20*b* very close together, for example, on the order of 1.2–1.4 millimeters apart. This is advantageous, as it helps to decrease the size of fluid ejection head 18, and thus the manufacturing cost of the fluid ejection head. However, this also places the orifices 22*a* that are most closely adjacent to the orifices 22*b* a distance of approximately one millimeter from orifices 22*b*.

Figure 3:
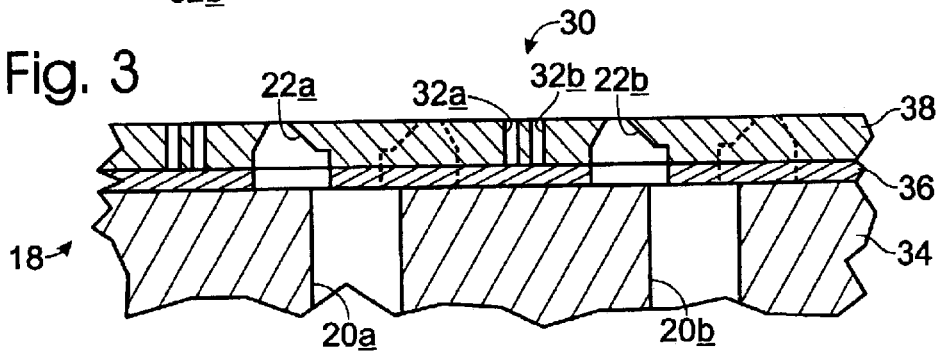
FIG. 3 is a sectional view of the fluid ejection head of FIG. 2, taken along line 3—3 of FIG. 2.

To help prevent cross-contamination of fluids ejected from fluid ejection orifices 22*a* and fluids ejected from fluid ejection orifices 22*b*, fluid ejection head 18 also includes a cross-contamination barrier disposed between fluid ejection orifices 22*a* and 22*b*. FIG. 2 shows, generally at 30, a first exemplary embodiment of a suitable cross-contamination barrier, and FIG. 3 shows a cross-sectional view of the barrier. Barrier 30 includes a pair of trenches or channels 32*a*, 32*b* configured to form a sufficient break in the surface of fluid ejection head 18 to prevent puddles of fluid from fluid ejection orifices 22*a* from spreading far enough to contaminate fluid ejection orifices 22*b*, and vice versa. In some embodiments, channels 32*a* and 32*b* are also configured to prevent the wave of fluid pushed in front of a wiper in a wiping station from spreading to adjacent fluid ejection orifices. This helps to prevent different fluids from being mixed by the wiper, and thus helps to prevent cross-contamination of orifices 22*a* and 22*b* by the wiper. While the embodiment of FIGS. 2-3 has two generally parallel channels 32*a* and 32*b*, other embodiments of the cross-contamination barrier may have three, four, or more parallel channels.

Channels 32*a* and 32*b* may have any suitable structure. Referring to FIG. 3, the depicted fluid ejection head 18 includes a substrate layer 34, an intermediate protective layer 36, and an orifice layer 38. The surface of the substrate layer 34 typically includes circuit structures (not shown) configured to cause the ejection of fluid from a fluid ejection orifice when triggered by off-substrate circuitry, while orifice layer includes the structures that form the fluid ejection orifices and corresponding firing chambers. Fluid feed slots 20*a* and 20*b* are formed in substrate layer, while fluid ejection orifices 22*a* and 22*b* extend through protective layer 36 and orifice layer 38. Channels 32*a* and 32*b* of the depicted embodiment are formed in orifice layer 38, and extend completely through the orifice layer to protective layer 36. While channels 32*a* and 32*b* of the depicted embodiment extend through the entire thickness of orifice layer 38, it will be appreciated that the channels may also extend only partially through the orifice layer.

In some embodiments, protective layer 36 is configured to protect the surface of substrate layer 34 and the circuit structures thereon from any reactive and/or corrosive fluids that may enter channels 32*a* and 32*b*. Protective layer 36 may be made from any suitable material, including, but not limited to, epoxy-based photoresists such as an SU-8 resist, available from MicroChem, Inc. or Sotec Microsystems. Similarly, protective layer 36 may have any suitable thickness. Where protective layer 36 is formed from SU-8, a relatively thin layer, on the order of approximately two to four microns, may be used to form protective layer 36. This may be advantageous, as a relatively thin layer of protective material may be less expensive to fabricate than a thicker protective layer. It will be appreciated that protective layer 36 may be omitted entirely if desired. In embodiments where protective layer 36 is omitted, the circuit structures on the surface of substrate layer 34 may include other protective means as known to those of skill in the art.

Channels 32*a* and 32*b* may be formed at any suitable location between fluid ejection orifices 22*a* and 22*b*. In the depicted embodiment, the halfway point between channels 32*a* and 32*b* is positioned approximately halfway between fluid feed slot 20*a* and fluid feed slot 20*b*, although the two channels may be centered at another location if desired. In some embodiments, channels 32*a* and 32*b* are centered substantially intermediate fluid ejection orifices 22*a* and 22*b*, as placing the center channels closer to the midway point between orifices 22*a* and 22*b* allows a larger puddle to form on either side of the channels before the puddle encounters the channels. This may make the puddle less likely to fill, and thus bridge, the channel.

Channels 32*a* and 32*b* may be separated by any suitable distance. For example, where fluid feed slots 20*a* and 20*b* are separated by a distance of approximately 1.4 millimeters, channels 32*a* and 32*b* may be separated by a distance in the range of 25–100 microns, and more typically by a distance of approximately 50 microns. Likewise, channels 32*a* and 32*b* may have any suitable widths. Suitable widths include, but are not limited to, those in the range of approximately 20–80 microns. More typically, channels 32*a* and 32*b* have widths of approximately 50 microns.

Channels 32*a* and 32*b* may also have any suitable length. Typically, channels 32*a* and 32*b* are configured to extend at least as far as the length of columns 21 and 21' of fluid ejection orifices so that no straight path exists between any of fluid ejection orifices 22*a* and any of fluid ejection orifices 22*b*. In some embodiments, channels 32*a* and 32*b* may be configured to extend beyond the ends of columns 21 and 21' of fluid ejection orifices to add additional protection against cross-contamination. In these embodiments, channels 32*a* and 32*b* may extend any desired distance beyond the ends of columns 21 and 21' of fluid ejection orifices. Suitable distances include, but are not limited to, approximately 300–500 microns beyond each end of columns 21 and 21' of fluid ejection orifices. In some embodiments, due to the manufacturing processes used to make fluid ejection head 18, columns 21 and 21' of fluid ejection orifices may include some orifices that are not fluidically connected to fluid feed slots 20*a* or 20*b*. In these embodiments, channels 32*a* and 32*b* may have a length that extends as far as (or beyond) the last fluidically connected fluid ejection orifice.

Likewise channels 32*a* and 32*b* may have any suitable depth. For example, as described above, channels 32*a* and 32*b* may extend only partway through orifice layer 38, or all the way through orifice layer 38. Typical depths of channels 32*a* and 32*b* include, but are not limited to, depths ranging from approximately 10 microns to the entire depth of the orifice layer, which is typically 20–100 microns thick.

Channels 32*a* and 32*b* may be formed in any suitable manner. In some embodiments, channels 32*a* and 32*b* are formed as fluid ejection orifices 22*a* and 22*b* are formed. In these embodiments, the formation of channels 32*a* and 32*b* may not significantly increase the cost and/or difficulty of the overall fluid ejection head manufacturing process. The method or methods used to form channels 32*a* and 32*b* typically depend upon the material and/or materials from which orifice layer 38 is formed. In some embodiments, a photoresist, such as an SU-8 resist, may be used to form orifice layer 38.

Figure 4:
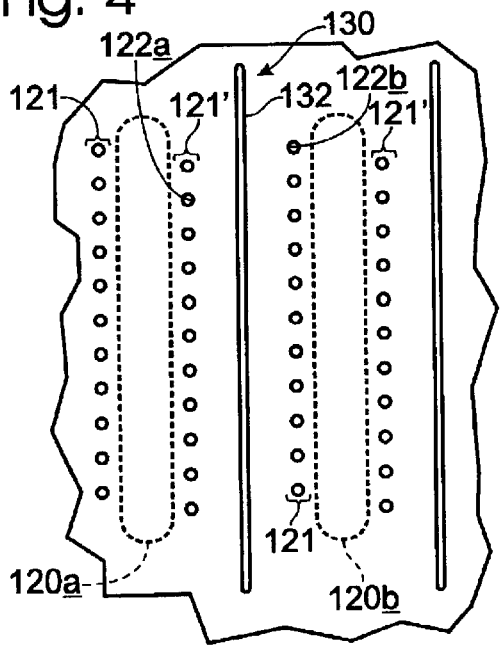
FIG. 4 is a magnified, broken-away plan view of a second alternative fluid ejection head of the embodiment of FIG. 1.

FIG. 4 shows, generally at 130, a second alternative embodiment of a cross-contamination barrier according to the present invention. In this embodiment, barrier 130 includes a single continuous channel 132. Channel 130 may have any suitable dimensions, including, but not limited to, those described above for each of channels 32*a* and 32*b* of the embodiment of FIGS. 2-3. The depicted channel 132 runs beyond the length of columns 121 and 121' of fluid ejection orifices, and is situated approximately halfway between fluid feed slots 120*a* and 120*b*. Likewise, channel 132 may have any suitable width. Suitable widths include, but are not limited to, widths between approximately fifty to five hundred microns (or approximately 5–50% of the spacing between fluid feed slots 120*a* and 120*b*).

Figure 5:
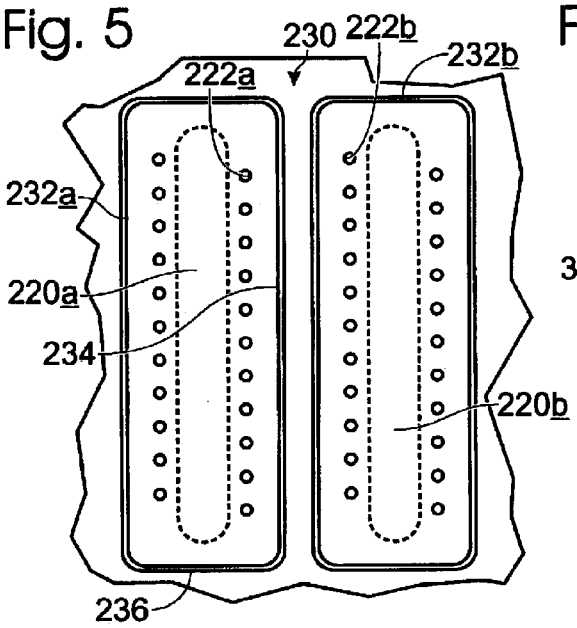
FIG. 5 is a magnified, broken-away plan view of a third alternative fluid ejection head of the embodiment of FIG. 1.

FIG. 5 shows, generally at 230, a third alternative embodiment of a cross-contamination barrier according to the present invention. Barrier 230 includes a first channel 232*a* surrounding fluid feed slot 220*a* and fluid ejection orifices 222*a* in a closed loop, and a second channel 232*b* surrounding fluid feed slot 220*b* and fluid ejection orifices 222*b* in a closed loop. The details of barrier 230 are described herein in terms of first channel 232*a*. However, it will be appreciated that the description is equally applicable to second channel 232*b*.

In some embodiments, channel 232*a* is configured to surround fluid ejection orifices 222*a* substantially completely to help to prevent fluid puddles from spreading in any direction from the fluid ejection orifices. Channel 232*a* may have any suitable dimensions, and may be formed in any suitable location on fluid ejection head 18. Typically, channel 232*a* is positioned 200–500 microns from the nearest fluid ejection orifices 222*a* along the long side or dimension 234 of the channel, and 100–500 microns from the nearest fluidically-connected fluid ejection orifice along the short side or dimension 236 of the channel, although channel 232*a* may also be separated from fluid ejection orifices 222*a* by distances outside of these ranges. Channel 232*a* may also have any suitable width. Channel 232 may have a width between approximately 20 and 200 microns, or between approximately 5*014 100* microns. While the depicted channels 232*a* and 232*b* completely surround the respective fluid ejection orifices, the channels may also only partially surround the fluid ejection orifices if desired.

Figure 6:
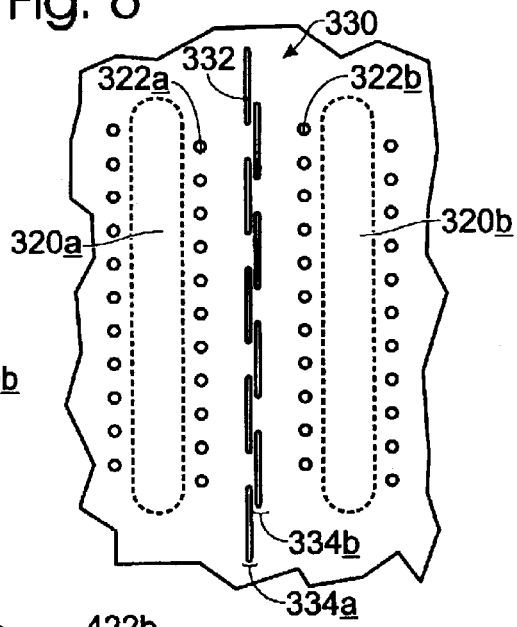
FIG. 6 is a magnified, broken-away plan view of a fourth alternative fluid ejection head of the embodiment of FIG. 1.

FIG. 6 shows, generally at 330, another embodiment of a suitable cross-contamination barrier according to the present invention formed between fluid feed slots 320*a* and 320*b*. Instead of having a channel that extends in a continuous manner the entire length of the columns of fluid ejection orifices, barrier 330 includes a plurality of shorter channels 332 arranged in a grate-like arrangement. In the depicted embodiment, the individual shorter channels are arranged into two columns of channels, indicated at 334*a* and 334*b*. The individual channels of channel column 334*a* are offset along the direction of the length of the channel columns with respect to the individual channels of channel column 334*b*. The offset configuration helps to ensure that no direct path exists between fluid ejection orifices 322*a* and 322*b* of slots 320*a* and 320*b*, respectively.

The individual channels 332 of channel columns 334*a* and 334*b* may have any suitable dimensions. Suitable lengths for channels 332 include, but are not limited to, lengths of 700–1100 microns. Furthermore, each of channel columns 334*a* and 334*b* may have any suitable number of individual channels. For example, where the fluid ejection head has a height (along the long dimension of the fluid feed slots and fluid ejection orifice channels) of 8500 microns, and the individual channels 332 each have a length of 900 microns, one channel column may have seven individual channels, and the other channel column may have six individual channels.

Figure 7:
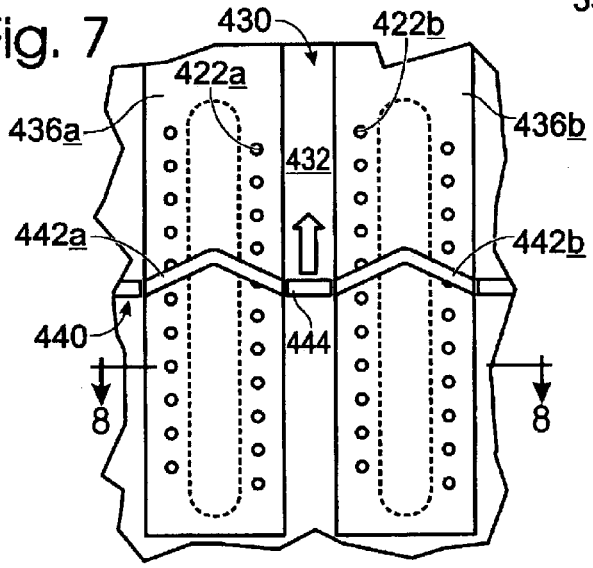
FIG. 7 is a magnified, broken-away plan view of a fifth alternative fluid ejection head of the embodiment of FIG. 1, and an exemplary wiper structure suitable for use with the fluid ejection head.
Figure 8:
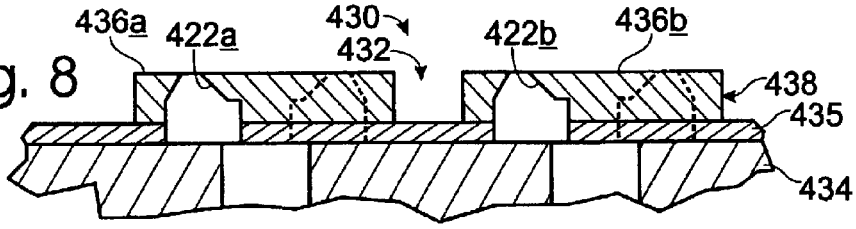
FIG. 8 is a sectional view of the fluid ejection head of FIG. 7, taken along line 8—8 of FIG. 7.

FIGS. 7 and 8 show, generally at 430, another embodiment of a cross-contamination barrier according to the present invention. In this embodiment, barrier 430 elevates the fluid ejection orifices above a surrounding waste-receiving portion 432 of the fluid ejection head on plateau-like structures, indicated at 436*a* and 436*b*. For example, where fluid ejection orifices 422*a* and 422*b* are positioned approximately 1.2 millimeters apart, waste-receiving portion 432 may be as wide as approximately one millimeter, or even wider.

The fluid ejection heads of FIGS. 5 and 7 are formed in a substantially similar manner. In some embodiments, the barriers 230, 430 are formed by masking the resist layer and exposing the resist layer to form the desired shapes. In these embodiments, the difference in formation is the use of different resist masks. One type of resist mask may be used to form the closed loop configuration of FIG. 5 and its orifices, while a second type of resist mask may be used to form the waste receiving portion of FIG. 7 and its orifices. The masked used in FIG. 7 allows the removal of more resist than the mask of FIG. 5.

Furthermore, as shown in FIG. 8, waste-receiving portion 432 may extend the full thickness of orifice layer 438 (to the intermediate protective layer 435), or may extend only partially through the thickness of the orifice layer.

The various embodiments of the channel and barrier structures described above may be used in conjunction with complementary wiper structures to further help reduce the risk of cross-contamination of fluids on the fluid ejection head. One example of a suitable wiper structure is shown generally at 440 in FIG. 7.

Wiper structure includes orifice wipers 442*a* and 442*b* configured to wipe over fluid ejection orifices 422*a* and 422*b*, respectively, and waste-receiving portion wipers 444 configured to clean waste-receiving portion 432.

Orifice wipers 442*a* and 442*b* are configured to push fluids off of plateaus 436*a* and 436*b* and into adjacent waste-receiving portion 432. Orifice wipers 442*a* and 442*b* may have any suitable structure. For example, each orifice wiper 442*a* and 442*b* may have a wiping structure with a diagonal orientation relative to the direction of wiper movement across plateaus 436*a* and 436*b*. This structure may push fluids into the waste-receiving portion 432 adjacent the lagging edge of the wiper. Alternatively, as in the depicted embodiment, orifice wipers 442*a* and 442*b* may have a chevron-shaped wiping structure. Thus, orifice wipers 442*a* and 442*b* push fluids toward channels 432 on either side of plateaus 436*a* and 436*b*.

Waste-receiving portion wiper 444 is positioned between (and on either side of) plateaus 436*a* and 436*b*, and is configured to extend into waste-receiving portion 432 to wipe fluids from the waste-receiving portion. Waste-receiving portion wiper 444 may have any suitable configuration. For example, waste-receiving portion wiper 444 may have a concave structure to move fluids away from the sides of plateaus 436*a* and 436*b* as the orifice wiper is moved across the fluid ejection head. Alternatively, as shown in the depicted embodiment, waste-receiving portion wiper 444 may have a generally straight shape, and may be oriented generally perpendicular to the direction in which wiper 440 is moved across the surface of the fluid ejection head.

In some embodiments, orifice wipers 442*a* and 442*b* may be configured to wipe across the surface independently of waste-receiving portion wiper 444. In these embodiments, orifice wipers 442*a* and 442*b* may be configured to wipe across plateaus 436*a* and 436*b* at a different period and/or frequency as waste-receiving portion wiper 444 across waste-receiving portion 432. For example, orifice wipers 442*a* and 442*b* may be configured to wipe across plateaus 436*a* and 436*b* after two minutes of fluid ejection head use, while waste-receiving portion wiper 444 may be configured to clean waste-receiving portion 432 less frequently, for example, every twenty minutes. Likewise, in some embodiments, orifice wipers 442*a* and 442*b* may be pressed against a fluid ejection head at different pressures during a wiping process (or processes), and may be made from different materials.

Figure 9:
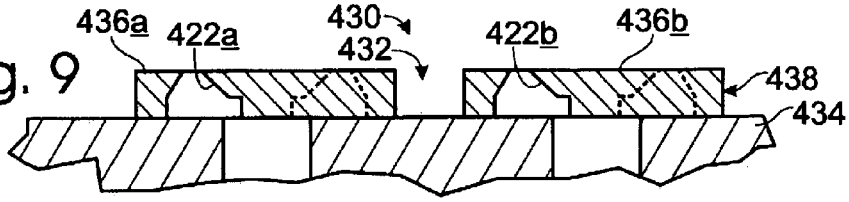
FIG. 9 is a sectional view of an alternate embodiment of the fluid ejection head of FIG. 7.

As mentioned above, the intermediate protective layer 435 between orifice layer 438 and substrate layer 434 may be omitted if desired. FIG. 9 shows a sectional view of an alternative embodiment of the fluid ejection head of FIG. 7, with the protective layer 435 omitted. In this embodiment, waste-receiving portion 432 extends to substrate layer 434. Where the fluids ejected by the fluid ejection device may be corrosive to and/or reactive with the surface of substrate layer 434, the surface of the substrate layer may be converted to, coated with, or otherwise treated with a substance that is less reactive chemically with the fluids.

Figure 10:
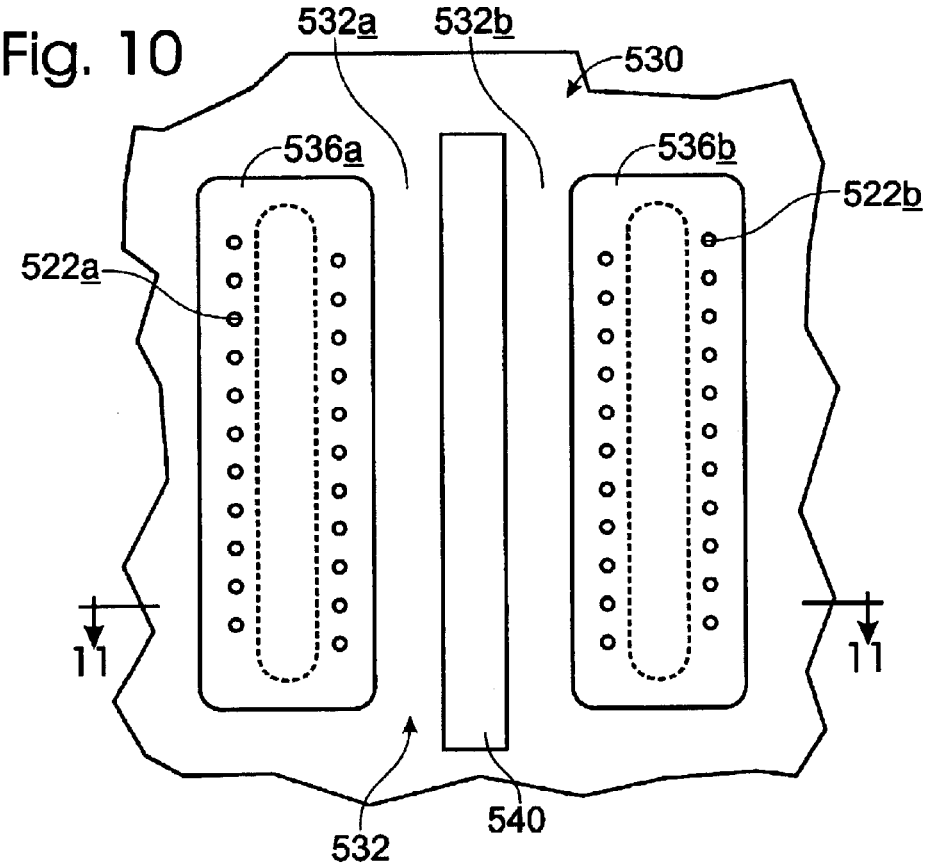
FIG. 10 is a magnified, broken-away plan view of a sixth alternative fluid ejection head of the embodiment of FIG. 1.
Figure 11:
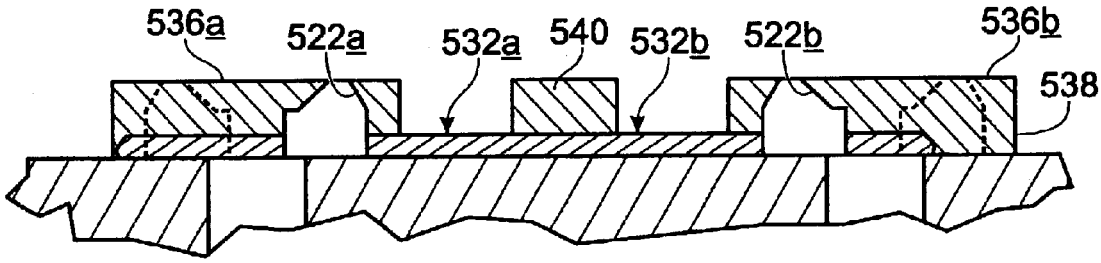
FIG. 11 is a sectional view of the fluid ejection head of FIG. 10, taken along line 11—11 of FIG. 10.

FIGS. 10 and 11 show a fluid ejection head having another embodiment of a cross-contamination barrier 530 according to the present invention. Like the embodiment of FIGS. 7-8, barrier 530 elevates fluid ejection orifices 522*a* and 522*b* above a surrounding waste-receiving portion 532 of the fluid ejection head on plateau-like structures, indicated at 536*a* and 536*b*. However, barrier 530 also includes a wall 540 running the length of waste-receiving portion 532, dividing waste-receiving portion 532 into a first waste-receiving portion 532*a* and a second waste-receiving portion 532*b*. The embodiment of FIGS. 10 and 11 is similar to the embodiment of FIG. 5, but with wider channels. Wall 540 may help to serve as a further barrier against cross-contamination, and also may allow fabrication of barrier 530 with less etching of orifice layer 538. It will be appreciated that a suitable wiper structure (not shown) with a waste-receiving portion wiper for each of first and second waste-receiving portions 538*a* and 538*b* may be employed to clean the barrier structure of the embodiment of FIGS. 10 and 11.

The channel structures disclosed herein may offer additional benefits besides helping to prevent cross-contamination of fluids. For example, in conventional fluid ejection heads with no contamination barrier channels, the wiping force from the fluid ejection head wiping structures is distributed across the entire fluid ejection head. However, in the disclosed embodiments, due to the presence of the contamination barrier channels, the wiping force may be more concentrated on the fluid ejection orifices, which may lead to a more efficient and complete wipe. Additionally the channels may provide some amount of stress relief in the orifice layer of the fluid ejection head, and thus may help to prevent damage caused by thermal expansion differences between the substrate layer, the intermediate protective layer, and the orifice layer.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A fluid ejection head, wherein the fluid ejection head includes an orifice layer disposed on top of a substrate layer, the fluid ejection head comprising:

a first group of fluid ejection orifices and a second group of fluid ejection orifices formed in the orifice layer, wherein the first group of fluid ejection orifices and the second group of fluid ejection orifices are configured to eject two different fluids; and an elongate channel formed in the orifice layer, wherein the channel is positioned between the first group of fluid ejection orifices and the second group of fluid ejection orifices in such a location as to inhibit cross-contamination of fluids ejected from the first group of fluid ejection orifices and the second group of fluid ejection orifices.

2. The fluid ejection head of claim 1, wherein the first group of fluid ejection orifices are arranged in a first column and wherein the second group of fluid ejection orifice are arranged in a second column, the first and second columns of fluid ejection orifices having a length, and wherein the channel extends the length of the first and second columns of fluid ejection orifices.

3. The fluid ejection head of claim 2, wherein the channel extends between approximately 300–500 microns past the last fluidically connected orifice of each of the first and second columns of fluid ejection orifices.

4. The fluid ejection head of claim 1, wherein the channel has a width of approximately 50 microns.

5. The fluid ejection head of claim 1, wherein the first group of fluid ejection orifices and the second group of fluid ejection orifices are spaced approximately 1–1.4 millimeters apart, and wherein the channel is spaced approximately 0.4–0.8 millimeters from the closer of the first group of fluid ejection orifices and the second group of fluid ejection orifices.

6. The fluid ejection head of claim 5, wherein the channel is spaced approximately midway between the first group of fluid ejection orifices and the second group of fluid ejection orifices.

7. The fluid ejection head of claim 1, wherein the channel extends the full depth of the orifice layer.

8. The fluid ejection head of claim 1, wherein the channel is a first channel, and further comprising a second channel running generally parallel to the first channel.

9. The fluid ejection head of claim 8, wherein the second channel is spaced by a distance of approximately 150 microns from the first channel.

10. The fluid ejection head of claim 8, wherein the first group of fluid ejection orifice are arranged in a first column of fluid ejection orifices and wherein the second group of fluid ejection orifices are arranged in a second column of fluid ejection orifices, the first and second columns of fluid ejection orifices each having a length, and wherein the first and second channels each run at least the length of the first and second columns of fluid ejection orifices.

11. The fluid ejection head of claim 8, wherein the first group of fluid ejection orifices are arranged in a first column of fluid ejection orifices and wherein the second group of fluid ejection orifices are arranged in a second column of fluid ejection orifices, the first and second columns of fluid ejection orifices each having a length, and wherein each of the first channel and the second channel extend only partially along the lengths of the first and second columns of fluid ejection orifices.

12. The fluid ejection head of claim 11, wherein the first channel is offset relative to the second channel along a long dimension of the first and second channels.

13. The fluid ejection head of claim 11, wherein the first channel is one channel of a plurality of channels in a first channel column, wherein the second channel is one channel of a plurality of channels in a second channel column, and wherein each channel in the first channel column is offset in a lengthwise direction with respect to each channel in the second channel column.

14. The fluid ejection head of claim 13, wherein each channel in the first channel column and each channel in the second channel column has a length of between approximately 700 and 1100 microns.

15. The fluid ejection head of claim 11, wherein the first channel and second channel have widths between approximately 30 and 50 microns.

16. The fluid ejection head of claim 1, wherein the first group of fluid ejection orifices are arranged in a column of fluid ejection orifices, and wherein the channel extends around the column of fluid ejection orifices in a closed loop.

17. The fluid ejection head of claim 16, wherein the channel is positioned between approximately 200 and 500 microns from a nearest fluid ejection orifice along a long dimension of the channel.

18. The fluid ejection head of claim 16, wherein the channel is positioned between approximately 100 and 500 microns from a nearest fluid ejection orifice along a short dimension of the channel.

19. The fluid ejection head of claim 1, wherein the fluid ejection head includes a protective layer disposed between the substrate layer and the orifice layer, and wherein the channel extends through the orifice layer to the protective layer.

20. The fluid ejection head of claim 1, wherein the channel is a first channel, and wherein the first channel includes a first plurality of shorter interrupted channels.

21. The fluid ejection head of claim 20, further comprising a second channel adjacent the first channel, wherein the second channel includes a second plurality of shorter interrupted channels, and wherein the shorter channels of the second plurality of channels are offset from the shorter channels of the first plurality of shorter channels.

22. A fluid ejection head, comprising:

a plurality of fluid ejection orifices disposed on the fluid ejection head, wherein the plurality of fluid ejection orifices are arranged into at least a first group of orifices and a second group of orifices, the first group of orifices and the second group of orifices having a length and being configured to eject different fluids; and at least two waste channels disposed on the fluid ejection head between the first group of orifices and the second group of orifices at a location substantially intermediate the first group of orifices and the second group of orifices, wherein the waste channels extend in a parallel manner between the first group of orifices and the second group of orifices the length of the first and second group of orifices to prevent cross-contamination of fluids ejected from the first group of orifices and fluids ejected from the second group of orifices.

23. The fluid ejection head of claim 22, wherein the waste channels are approximately 150 microns apart.

24. The fluid ejection head of claim 22, wherein the waste channels extend between approximately 300–500 microns beyond a last fluidically-connected fluid ejection orifice.

25. The fluid ejection head of claim 22, wherein the waste channels each have a width of approximately 50 microns.

26. The fluid ejection head of claim 22, wherein the fluid ejection head includes a substrate layer, an orifice layer in which the fluid ejection orifices and channels are formed, and an intermediate protective layer disposed between the substrate layer and the orifice layer, and wherein the channels extend through the orifice layer to the intermediate protective layer.

27. A fluid ejection head including a substrate layer and an orifice layer formed over the substrate layer, the fluid ejection head comprising:

a first group of orifices and a second group of orifices formed in the orifice layer, wherein each of the first group of orifices and second group of orifices includes a plurality of fluid ejection orifices; and a trench formed in the orifice layer, wherein the trench divides the first group of orifices from the second group of orifices at a location between the first and second groups of orifices to inhibit cross-contamination of fluids ejected from the first group of orifices and fluids ejected from the second group of orifices.

28. The fluid ejection head of claim 27, the orifice layer having a thickness, wherein the trench extends completely through the thickness of the orifice layer.

29. The fluid ejection head of claim 27, further comprising a protective layer disposed between the substrate layer and the orifice layer, wherein the trench extends through the orifice layer to the protective layer.

30. The fluid ejection head of claim 29, wherein the protective layer is at least partially formed from SU-8.

31. The fluid ejection head of claim 27, wherein the orifice layer is at least partially formed from SU-8.

32. A method of making a fluid ejection head, comprising:

forming a plurality of fluid ejection orifices in the fluid ejection head, the plurality of fluid ejection orifices including a first group of orifices and a second group of orifices; and forming an elongate channel in the fluid ejection head in a location substantially intermediate the first group of orifices and the second group of orifices, wherein the elongate channel is configured to prevent cross-contamination of fluids ejected from the first group of orifices and fluids ejected from the second group of orifices, wherein the fluid ejection head includes a substrate layer and an orifice layer, and wherein the fluid ejection orifices and channel are formed in the orifice layer.

33. The method of claim 32, wherein the channel extends through the orifice layer to the substrate layer.

34. The method of claim 32, wherein the channel extends through the orifice layer to an intermediate protective layer disposed between the orifice layer and the substrate layer.

35. The method of claim 32, wherein the fluid ejection head includes a protective layer disposed between the substrate layer and the orifice layer, and wherein the channel extends through the orifice layer to the protective layer.

36. The method of claim 32, wherein forming the channel includes forming two generally parallel channels in the fluid ejection head between the first group of orifices and the second group of orifices.

37. A method of making a fluid ejection head, comprising:

forming a plurality of fluid ejection orifices in the fluid ejection head, the plurality of fluid ejection orifices including a first group of orifices and a second group of orifices; and forming an elongate channel in the fluid ejection head in a location substantially intermediate the first group of orifices and the second group of orifices, wherein the elongate channel is configured to prevent cross-contamination of fluids ejected from the first group of orifices and fluids ejected from the second group of orifices, wherein forming the channel includes forming two generally parallel channels in the fluid ejection head between the first group of orifices and the second group of orifices, wherein the first group of orifices has a length, and wherein the two channels each extend at least the length of the first group of orifices.

38. The method of claim 36, wherein the two channels are separated by a distance of approximately 50 microns.

39. A method of making a fluid ejection head, comprising:

forming a plurality of fluid ejection orifices in the fluid ejection head, the plurality of fluid ejection orifices including a first group of orifices and a second group of orifices; and forming an elongate channel in the fluid ejection head in a location substantially intermediate the first group of orifices and the second group of orifices, wherein the elongate channel is configured to prevent cross-contamination of fluids ejected from the first group of orifices and fluids ejected from the second group of orifices, wherein forming the channel includes forming a first channel around the first group of fluid ejection orifices in a closed loop and forming a second channel around the second group of fluid ejection orifices in a closed loop, the first and second channels being spaced by at least approximately 100 microns from the fluid ejection orifices in the first group of fluid ejection orifices and the second group of fluid ejection orifices, respectively.

40. A method of making a fluid ejection head, comprising:

forming a plurality of fluid ejection orifices in the fluid ejection head, the plurality of fluid ejection orifices including a first group of orifices and a second group of orifices; and forming an elongate channel in the fluid ejection head in a location substantially intermediate the first group of orifices and the second group of orifices, wherein the elongate channel is configured to prevent cross-contamination of fluids ejected from the first group of orifices and fluids ejected from the second group of orifices, wherein forming the channel includes forming a plurality of channels that are arranged in at least a first column of channels and a second column of channels, and wherein each of the first column of channels and the second column of channels includes a plurality of channels.

41. The method of claim 40, wherein the channels of the first column of channels are offset relative to the channels of the second column of channels along a long dimension of the first and second columns of channels.

* * * * *